United States Patent [19]

Kariya et al.

[11] Patent Number: 4,808,881

[45] Date of Patent: Feb. 28, 1989

[54] CERAMIC ENVELOPE DEVICE FOR HIGH-PRESSURE DISCHARGE LAMP

[75] Inventors: Mikio Kariya; Hirotsugu Izumiya, both of Nagoya, Japan

[73] Assignee: NGK Insulators, Ltd., Nagoya, Japan

[21] Appl. No.: 135,255

[22] Filed: Dec. 21, 1987

[30] Foreign Application Priority Data

Dec. 24, 1986 [JP] Japan ..... 61-310621

[51] Int. Cl.[4] ..... H01J 61/36; H01J 61/30

[52] U.S. Cl. ..... 313/624; 313/625; 313/634

[58] Field of Search ..... 313/624, 625, 623, 634

[56] References Cited

U.S. PATENT DOCUMENTS

| | | | |
|---|---|---|---|
| 4,155,757 | 5/1979 | Hing . | |
| 4,155,758 | 5/1979 | Evans et al. . | |
| 4,665,344 | 5/1987 | Kajihara et al. | 313/624 |
| 4,687,969 | 8/1987 | Kajihara et al. | 313/625 |
| 4,694,219 | 9/1987 | Hing | 313/624 X |

*Primary Examiner*—Palmer C. DeMeo

*Attorney, Agent, or Firm*—Parkhurst, Oliff & Berridge

[57] ABSTRACT

A ceramic envelope device for use in a HID (high intensity discharge) lamp, which includes: (a) a translucent ceramic tube; (b) a pair of electrically conductive end caps which close longitudinally opposite ends of the ceramic tube; (c) a pair of oppositely located discharge electrodes each of which is supported at a first end thereof by a corresponding one of the end caps such that a second end of each electrode protrudes from an inner surface of the corresponding end cap in a longitudinally inward direction in the ceramic tube; (d) an electrical insulator provided for one or both of the pair of end caps; and (e) a sealing member disposed to maintain fluid-tightness between an engaging portion of the end cap for which the electrical insulator is provided, and the corresponding end of the ceramic tube. The electrical insulator includes a peripheral portion which covers a peripheral portion of the inner surface of the corresponding end cap, and the end of the ceramic tube sealed by the sealing member includes a contact portion which contacts the peripheral portion of the electrical insulator, to thereby isolate the sealing member from an inner space in which the second end of each discharge electrode extends.

7 Claims, 4 Drawing Sheets

CERAMIC ENVELOPE DEVICE FOR HIGH-PRESSURE DISCHARGE LAMP

BACKGROUND OF THE INVENTION

1. Field of the Invention

The present invention relates in general to a ceramic envelope device for use in a high-pressure discharge lamp (hereinafter referred to as "HID lamp"; "HID" representing High Intensity Discharge), and more particularly to the structure of one or both ends of such a ceramic envelope device at which a translucent ceramic tube of the envelope device is closed by an electrically conductive end cap and sealed by a sealing member provided between the end cap and the ceramic tube.

2. Discussion of the Prior Art

In the art of such HID lamps using a translucent ceramic tube, a pair of electrically conductive discs are known as end caps to close the longitudinally opposite open ends of the translucent ceramic tube. Examples of such closure end caps are illustrated in U.S. Pat. Nos. 4,155,757 and 4,155,758. Such end caps are formed of an electrically conductive cermet obtained by mixing, for example, particles of tungsten with particles of aluminum oxide, and sintering the mixture. These electrically conductive cermet end caps support at their inner surfaces, a pair of discharge electrodes of tungsten so that the electrodes protrude from the respective inner surfaces of the end caps toward each other, i.e., longitudinally inward in the translucent ceramic tube. Also, electrical contact rods or lead rods are connected or fixed to the outer surfaces of the cermet end caps by suitable methods, so that electric power is applied to the pair of oppositely located tungsten electrodes through the contact rods and through the cermet end caps.

Such cermet end caps have been advantageously employed, for example, in high-pressure sodium lamps, because they eliminate the need of using expensive metallic niobium. It is further recognized that such cermet end caps have been advantageously used for so-called metal halide lamps which employ a translucent ceramic tube charged with a suitable metal halide for improved color-rendering, as well as with mercury and rare gas, because the cermet exhibits relatively high corrosion resistance to metal halides.

However, such a HID lamp with a translucent ceramic tube closed by cermet end caps may suffer from a problem generally known as "arc-back" phenomenon wherein an arc will take place between the discharge electrodes and the corresponding cermet end caps, rather than between the oppositely located electrodes, when the HID lamp is initially turned on. This arc-back phenomenon causes the cermet end caps to crack, thereby causing the ceramic envelope device to leak. In addition, the "arc-back" phenomenon gives rise to vaporization and scattering of the refractory metal components in the cermet, and consequent deposition thereof on the inner surface of the ceramic tube, which results in blackening of the wall of the ceramic tube, thereby reducing the luminous flux of the envelope device. For overcoming this problem, it has been recommended in the art that an electrical insulator in the form of an insulating layer be provided on the inner surfaces of the cermet end caps from which the electrodes protrude.

As to the metal halide lamp indicated above, it is also recognized that supersaturated metal halide in the ceramic tube may condense at the cold spot in the ceramic tube (i.e., at the lower end portion of the ceramic tube disposed vertically when the lamp is used in its upright position), whereby a sealing member provided for sealing the lower end of the ceramic tube is subjected to corrosion due to the liquid phase of the condensed metal halide and the heat generated by the lower electrode in use, with a result of deterioration of the lamp properties and/or causing the ceramic envelope device to leak. For overcoming these problems, it has been practiced in the art that the lower end portion of the ceramic tube be gas-tightly closed or sealed by a shrinkage-fit of a cermet end cap, without using any sealing means. In this case, the upper end of the ceramic tube is closed by a cermet end cap and sealed by a sealing member, after charging of the ceramic tube with a suitable metal halide through the upper end thereof.

In the above type of ceramic envelope device, at least one of the opposite ends of which is sealed by a sealing member or material, it is required to completely fill a gap between the ceramic tube and the at least one end cap with the sealing member. Consequently, the sealing member is partially exposed in an inner space of the ceramic tube in which the metal halide vapor is present, and the sealing member is subjected to corrosion due to the metal halide, though that corrosion might not be so severe as that of a sealing member located at the lower end of an envelope device of an upright-oriented lamp. Therefore, the HID lamp incorporating such a ceramic envelope is not free from the problems of the leakage of the envelope device or deteriorated operating characteristics such as lowered luminous flux (blackening of the wall of the ceramic tube) or change of color, temperature and lamp voltage.

Additionally, where the sealing between the ceramic tube and the cermet end cap with the sealing member is insufficient, that is, a side surface of the cermet end cap is not completely covered by the sealing member, the arc-back phenomenon may take place at the non-sealed portion of the cermet end cap, thereby causing the end cap, sealing member and/or ceramic tube to crack which in turn may cause leakage of the charged gases from the envelope device.

SUMMARY OF THE INVENTION

The present invention, which was made in view of the above-discussed inconveniences experienced in the prior art, has as its principal object the provision of a ceramic envelope device for use in an HID lamp, which is free from cracks in its cermet end caps due to the arc-back phenomenon and consequently free from leakage thereof, whereby the operating characteristics of the HID lamp are advantageously maintained notwithstanding repetitive uses during its service life.

According to the instant invention, there is provided a ceramic envelope device for use in a high-pressure metal-vapor discharge lamp, which includes: (a) a translucent ceramic tube having longitudinally opposite ends; (b) a pair of electrically conductive end caps which close the opposite ends of the ceramic tube, respectively, each of the end caps having an engaging portion which engages the corresponding one of the opposite ends of the ceramic tube; (c) a pair of oppositely located discharge electrodes each of which is supported at a first end thereof by a corresponding one of the end caps such that a second end of each electrode opposite to the first end protrudes from an inner surface of the corresponding end cap in a longitudinally inward direction in the ceramic tube; (d) an electrical insulator provided for at least one of the pair of end caps, the electrical insulator covering at least the inner surface of the corresponding one of the at least one end cap; and (e) a sealing member disposed to maintain fluid tightness between the engaging portion of each of the at least one end cap for which the electrical insulator is provided, and the corresponding end of the ceramic tube. The ceramic envelope device of the invention is characterized in that the electrical insulator includes a peripheral portion which covers a peripheral portion of the inner surface of each of the at least one end cap, and that the end of the ceramic tube sealed by the sealing member includes a contact portion which contacts the peripheral portion of the electrical insulator, to thereby isolate the sealing member from an inner space in which the second end of the discharge electrodes protrudes.

The HID lamp incorporating the ceramic envelope device constructed as described above maintains excellent operating characteristics, since the sealing member or members is/are isolated from the inner space of the envelope device in which corrosive metal vapor is present. Moreover, since the fluid-tight contact of the electrical insulator(s) on the end cap(s) with the contact portion(s) of the ceramic tube prevents the cermet material of the end cap(s) from exposure in the inner space in which an arc will take place, the end cap(s) is/are free from cracks due to the arc-back phenomenon. Consequently, the envelope device is free from leakage due to the arc-back phenomenon. Furthermore, the envelope device enjoys a greater latitude in the degree of sealing of its end or ends, since in the present invention it is not required to completely fill the gap(s) between the ceramic tube and the end cap(s) with the sealing material, as required in the conventional HID lamp manufacturing techniques. These features of the invention are of industrial significance.

In one embodiment of the invention, the ceramic envelope device further includes a pair of electrical lead members through which electric power is supplied to the pair of discharge electrodes via the pair of end caps, respectively, and each of the electrical lead members is supported on an outer surface of the corresponding end cap.

In another embodiment of the invention, the end caps are made of an electrically conductive cermet.

In the ceramic envelope device of the invention, it is preferred that the end of the ceramic tube sealed by the sealing member includes a first inner cylindrical surface having a first inside diameter, and a second inner cylindrical surface which is located axially inwardly of the first inner cylindrical surface and which has a second inside diameter smaller than the first inside diameter, and that the engaging portion of each of the at least one end cap for which the electrical insulator and the sealing member are provided has a diameter which is smaller than the first inside diameter and greater than the second inside diameter. In this case, the contact portion of the end of the ceramic tube has a shoulder surface disposed between the first and second inner cylindrical surfaces. The shoulder surface may be perpendicular to the first and second inner cylindrical surfaces.

In the present invention, it is also recommended that the end of the ceramic tube sealed by the sealing member has a tapered bore defined by a tapered inner surface, while the engaging portion of the corresponding end cap has a tapered outer surface whose taper angle is smaller than that of the tapered inner surface, whereby the contact portion of the end of the ceramic tube consists of the tapered inner surface thereof.

BRIEF DESCRIPTION OF THE DRAWINGS

The foregoing and other objects, features and advantages of the present invention will be apparent from reading the following detailed description of the preferred embodiment taken in conjunction with the accompanying drawings, in which.

DETAILED DESCRIPTION OF THE PREFERRED EMBODIMENT

To further clarify the present invention, one preferred embodiment of the invention will be described in detail with reference to the accompanying drawings.

Figure 1:
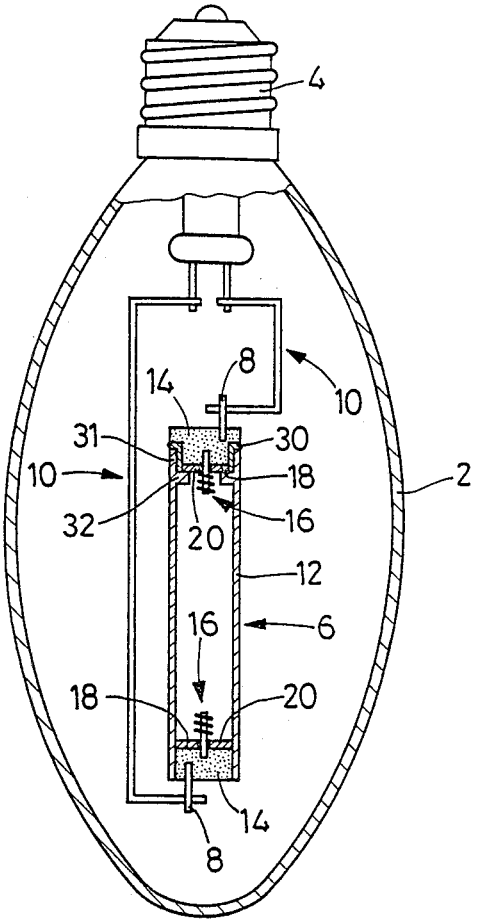
FIG. 1 is a schematic elevational view, partly in cross section, of an example of an HID lamp incorporating one embodiment of a ceramic envelope device of the invention, in which an upper end of a translucent ceramic tube of the envelope device is closed by an end cap and sealed by a sealing member.

Referring first to FIG. 1, there is schematically illustrated a complete assembly of an HID lamp which incorporates one embodiment of a ceramic envelope device 6 of the invention which will be described. In the figure, reference numeral 2 designates a bulbiform translucent jacket which is generally made of glass or similar material. This translucent jacket 2 is closed at its open end by a base 4. The jacket 2 and the base 4 cooperate to form a gas-tight enclosure which is charged with a suitable inert gas such as nitrogen, or maintained under vacuum. As is well known in the art, electric power applied to the base 4 is supplied, via electrical conductor members 10, 10, to electrically conductive lead members in the form of electrical contact rods 8, 8 which are disposed at the longitudinally opposite ends of the ceramic envelope device 6 accommodated in the translucent jacket 2.

The ceramic envelope device 6 includes a translucent ceramic arc tube 12 and a pair of closure discs in the form of end caps 14, 14 which are secured to the longitudinally opposite ends of the ceramic arc tube 12 such that the end caps 14, 14 close the opposite ends of the arc tube 12 so as to maintain gas-tightness of the ceramic envelope 6. The translucent ceramic arc tube 12 is a tubular member made of alumina or other ceramic materials. The end caps 14, 14 are formed of an electrically conductive cermet. A discharge electrode 16 as well as the contact rod 8 are embedded at their one end in each end cap 14. The ceramic arc tube 12 of the gas-tight ceramic envelope device 6 is charged with a suitable gas, and a suitable metal or its compound which is selected depending upon the specific type of the HID lamp. In the case of a high-pressure sodium lamp, for example, the arc tube 12 is charged with metallic sodium, mercury and rare gas. In a metal halide lamp, the arc tube 12 is charged with a metal halide (such as dysprosium iodide, thallium iodide, sodium iodide, indium iodide, etc.), together with mercury and rare gas.

The present invention relates to a ceramic envelope device in which at least one of the opposite ends of a translucent ceramic tube is closed by an end cap and sealed by a sealing member provided between the ceramic tube and the end cap. In the embodiment of FIG. 1, an upper end of the arc tube 12 is closed by the upper end cap 14 and sealed by a sealing member 30. On the other hand, the lower end cap 14 is fitted in the lower end of the arc tube 12 by shrinkage-fit process which utilizes shrinkage of the tube 12 and the end cap 14 when they are sintered. Each of the discharge electrodes 16, 16 and the contact rods 8, 8 is formed of a refractory metal such as tungsten. Each contact rod 8 is embedded at its one end in the outer portion of the corresponding end cap 14, such that the other end of the rod 8 protrudes outwardly from the outer surface of the end cap 14. In addition, each tungsten electrode 16 is embedded at its one end in the inner portion of the corresponding end cap 14, such that the other end of the electrode 16 protrudes from the inner surface 18 of the end cap 14 longitudinally inward in the translucent arc tube 12. Each electrode 16 is positioned at a radially central portion of the end cap 14 (arc tube 12), and consists of an electrode shank 15 with a predetermined diameter and a coil 19 which is wound around the shaft 15 with a free end of the shank 15 of a suitable length having no coil (19).

The inner surface 18 of each end cap 14 from which the corresponding electrode 16 protrudes is covered, except a portion thereof in the vicinity of the electrode 16, with an electrical insulator in the form of an insulating layer 20 of a suitable constant thickness. These insulating layers 20, 20 covering the inner surfaces 18, 18 of the electrically conductive end caps 14, 14, will serve to effectively prevent an "arc-back" phenomenon which is an electrical discharge between the insulating layers 20, 20 and the corresponding electrodes 16, 16 upon application of a voltage between the opposed electrodes 16, 16 through the contact rods 8, 8 at the moment when the HID lamp is turned on.

Figure 2:
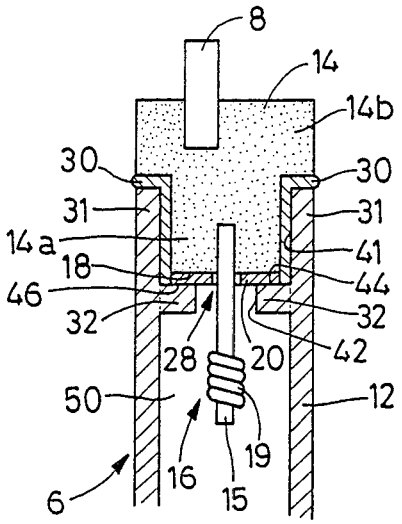
FIG. 2 is a fragmentary cross-sectional view showing in enlargement an upper end portion of the ceramic envelope device of the HID lamp of FIG. 1.

FIG. 2 shows in enlargement the upper end portion of the ceramic envelope device 6 of FIG. 1 which is sealed by the sealing member 30. FIGS. 3–5 and FIG. 9 are views corresponding to FIG. 2, each showing a modified structure of the upper end portion of the ceramic envelope device of the invention.

The translucent ceramic arc tube 12 of each example of FIGS. 2–5 has, at the upper end thereof, a first cylindrical portion 31 which has a first inner cylindrical surface 41 and a second cylindrical portion 32 which is concentric with the first portion 31 and located axially inwardly of the first portion 31 and has a second inner cylindrical surface 42. Inside diameters of the first and second portions 31 and 32 are determined such that a diameter of an engaging portion **14*a* of the upper end cap 14 which is fitted in the first portion 31 is smaller than the inside diameter of the first portion 31 and greater than the inside diameter of the second portion 32, and preferably greater than the average of the inside diameters of the first and second portions 31, 32. With the upper end of the arc tube 12 closed by the upper end cap 14, the insulating layer 20 on the inner surface 18 of the upper end cap 14 directly contacts at an entire peripheral portion 46 thereof a shoulder surface 44 of the second portion 32 which is perpendicular to the first and second inner cylindrical surfaces 41, 42. Thus, the sealing member 30 sealing the upper end of the arc tube 12 is isolated from an inner space 50 of the arc tube 12 (envelope device 6), in which the discharge electrodes 16, 16** extends and in which the charged gases are present.

Thus, the envelope device 6 of the illustrated embodiment is free from leakage of the charged gases resulting from deterioration of the sealing member 30 due to exposure thereof to the corrosive gas (e.g., metal halide) in the charged gases in the inner space 50. Therefore, excellent operating characteristics of the HID lamp are advantageously maintained during a prolonged period of use. Even in the case where a side surface of the end cap 14 is not covered by any electrical insulator and where the sealing between the arc tube 12 and the end cap 14 by the sealing material 30 is incomplete or insufficient, the end cap 14 is immune from the arc-back phenomenon, because the cermet of the end cap 14 is isolated from the inner space 50 in which an arc or electrical discharge will occur. This means a greater latitude in the degree of sealing between the end cap 14 and the arc tube 12.

Figure 3:
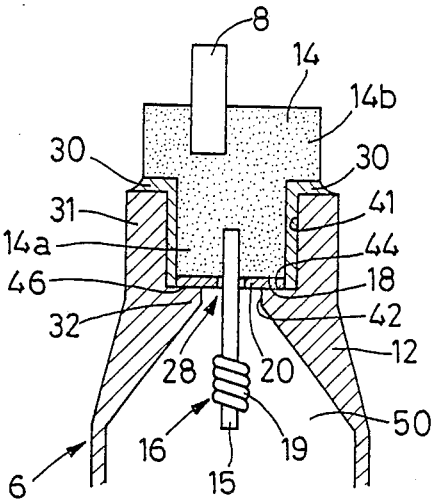
FIGS. 3–5 are views corresponding to FIG. 2, each illustrating a modified example of the ceramic envelope device of the invention.
Figure 4:
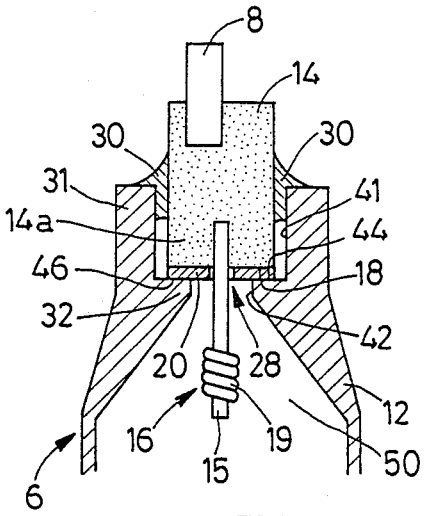
Figure 5:
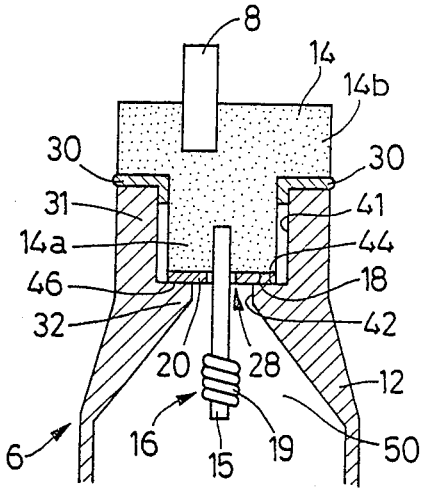

Where, as shown in FIG. 2, 3 or 5, the end cap 14 has an outer flange **14*b* whose diameter is greater than the inside diameter of the first cylindrical portion 31 of the arc tube 12, the sealing member 30 in the form of a ring, placed between the arc tube 12 and the outer flange of the end cap 14, is heated and melted so that the end cap 14 is lowered by its weight or under a suitable load, whereby the entire peripheral portion 46 of the insulating layer 20 is brought into fluid-tight contact with the shoulder surface 44 of the second cylindrical portion 32 of the arc tube 12. On the other hand, where as shown in FIG. 4 the end cap 14 has a proper cylindrical shape, the sealing material 30 is heated and melted between the arc tube 12 and the end cap 14 while the insulating layer 20 is in fluid-tight contact with the arc tube 12**.

The first and second cylindrical portions 31, 32 of the arc tube 12 of FIG. 2 is formed by fitting a ring of the same material as that of the arc tube 12, in a cylindrical end of the tube 12, by the shrinkage-fit process. Alternatively, those portions 31, 32 may be formed by press-forming process. In the examples of FIGS. 3–5, one of the longitudinally opposite tapered ends of the arc tube 12 is worked by an end-milling process or other suitable process to provide the first and second portions 31, 32. Alternatively, the first and second portions 31, 32 of each example of FIGS. 3–5 may be formed by the press-forming process. In all the examples of FIGS. 2–5, the inside diameters of the first and second portions 31, 32 of the arc tube 12 are different such that the inside diameter of the second portion 32 is smaller than that of the first portion 31.

In the examples of FIGS. 2 and 3, the sealing member or material 30 is used to completely fill the gap between the arc tube 12 and the end cap 14, while in the examples of FIGS. 4 and 5 the gap between the tube 12 and the end cap 14 is partially or insufficiently filled with the sealing material 30.

Figure 6:
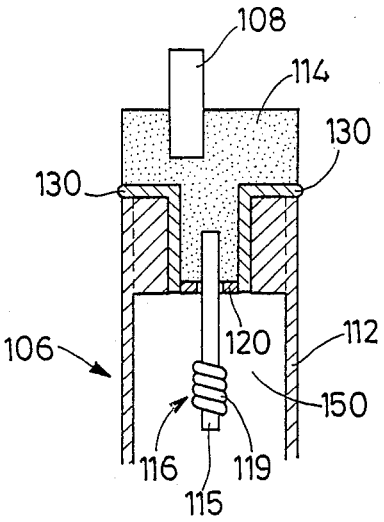
FIG.6 PRIOR ART
FIGS. 6–8 are views corresponding to FIG. 2, each showing an upper end portion of a conventional ceramic envelope device.
Figure 7:
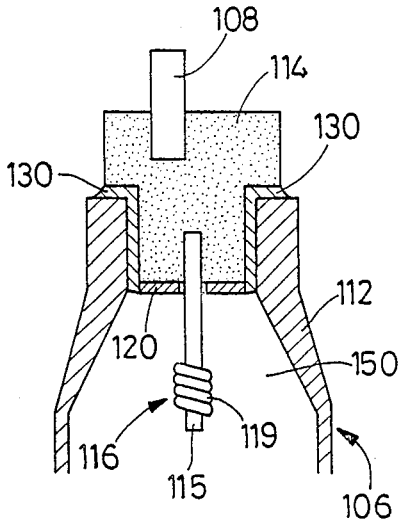
FIG.7 PRIOR ART
Figure 8:
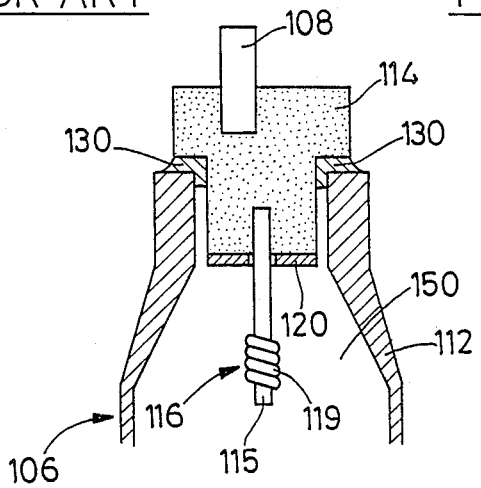
FIG.8 PRIOR ART

FIGS. 6–8 are views corresponding to FIG. 2, each showing conventional, prior art, ceramic envelope devices. A sealing member 130 of all the examples of FIGS. 6–8 is partially exposed to the gases charged in an inner space 150 of an arc tube 112. In the example of FIG. 8, the sealing between the arc tube 112 and an end cap 114 with the sealing member 130 is insufficient or incomplete, that is, a side surface of the end cap 114, which has no electrical insulator, is not covered by the sealing material 130. Thus, the cermet of the end cap 114 is exposed in the inner space 150 of the arc tube 112.

The electrically conductive end caps 14, 14 closing the opposite ends of the arc tube 12 of the envelope device 6 are formed of suitable known electrically conductive materials having a coefficient of thermal expansion which is intermediate between that of the material of the arc tube 12 and that of the refractory metal of the discharge electrodes 16, 16 (shanks 15, 15) and contact rods 8, 8. For example, composite materials of metallic tungsten or metallic molybdenum and aluminum oxide, or tungsten carbide, tungsten boride, or the like may be suitably used for the end caps 14, 14.

The insulating layers 20, 20, which are provided on the respective inner surfaces 18, 18 of the end caps 14, 14 on the side of the electrodes 16, 16, are made of known suitable electrically insulating materials, preferably refractory and electrically insulating ceramics having a thermal expansion coefficient close to that of the material of the end caps 14, 14. For example, the insulating layers 20, 20 are made of alumina, beryllia, spinel, or boron nitride. These layers 20, 20 are formed by a suitable known process. For instance, they are molded and sintered simultaneously as an integral part of the end caps 14, 14, or molded and sintered separately from the end caps 14, 14, or formed by applying a coating of a selected insulating material to a pre-sintered material of the end caps 14, 14 by a thermal spraying method or other suitable method. The electrodes 16, 16 and electrical rods 8, 8 are embedded in the thus-formed end caps 14, 14 having the insulating layers 20, 20 thereon, and the pair of end caps 14, 14 having the insulating layers 20, 20, electrodes 16, 16 and electrical rods 8, 8 are secured to the opposite ends of the ceramic arc tube 12, respectively, to provide the gas-tight envelope 6. This arrangement contributes to improved efficiency of production of the envelope 6.

In the embodiment of FIG. 1, the insulating layers 20, 20 are provided on only the inner surfaces 18, 18 of the end caps 14, 14 from which the electrodes 16, 16 protrude. However, the electrical insulators may be provided to cover the entire surfaces of the end caps 14, 14. The thickness of the insulating layers 20, 20 is determined to generally be within 0.05–0.8 mm, so that the insulating layers 20, 20 are effective to prevent the arc-back phenomenon. It is preferred that there are provided small distances 28, 28 between the insulating layers 20, 20 and the electrodes 16, 16, in order to prevent the insulating layers 20, 20 from cracking thereof and the arc-back phenomenon.

The material of the sealing member 30 is selected from known composite materials which exhibit high corrosion resistance to the charged gases (e.g., metal halide). For example, a composite material which is obtained by mixing two or more materials selected from the group including $Y_2O_3$, $La_2O_3$, $Dy_2O_3$, $Al_2O_3$ and $SiO_2$ and which has a suitable composition of the mixed materials (ingredients), is preferably used as a material for the sealing member 30. The sealing member 30 may be used in the form of a ring, which is formed by the press-forming process. The sealing ring 30 is placed between the end of the arc tube 12 and the end cap 14, and then heated in the atmosphere of argon gas at 1500° C. for several minutes, so that the ring 30 is melt to fluid-tightly seal between the arc tube 12 and the end cap 14. It is recommended that the material of the sealing member 30 has a thermal expansion coefficient close to that of the arc tube 12. Accordingly, where alumina is used as the material of the arc tube 12, a material having a thermal expansion coefficient of $70\text{–}90\times10^{-7}$/°C. (30° to 800° C.) is preferably used for the sealing member 30.

The ceramic envelope device of the present invention is used for the HID lamp such as a high-pressure sodium lamp and metal halide lamp, preferably for the metal halide lamp.

As previously described, the lower end of the arc tube 12 of FIG. 1 is closed by the end cap 14 by the shrinkage-fit process. However, the lower end may be closed by the end cap 14 and sealed by a sealing member of a glass frit or other suitable material.

While the present invention has been illustrated in its preferred embodiment, it is to be understood that the invention is not limited by the details of description of construction and arrangement, and that it is intended to cover all changes, modifications and improvements which are obvious to those skilled in the art, and which do not affect the spirit of the invention nor exceed the scope thereof.

For example, it is recommended to embed the electrode 16 or contact rod 8 in the end cap 14 together with a wire having a diameter smaller than that of the electrode 16 or contact rod 8, so as to provide a gap between the end cap 14 and the embedded electrode 16 or contact rod 8. The thus-provided gap will be effective to prevent the end cap 14 from cracking when the cap 14 is sintered for shrinkage-fit thereof in the end of the tube 12.

It is further noted that the insulating layer 20 located at the lower end of the envelope 6 in its upright posture may include a cylindrical protrusion surrounding the electrode 6, such that there is a suitable distance between the cylindrical protrusion and the electrode 6. The cylindrical protrusion of the layer 20 extends longitudinally inward from the constant-thickness portion of the same 20, surrounding the electrode 16 at the suitable distance therefrom. The cylindrical protrusion of the insulating layer 20 is effective to protect, in the vicinity of the electrode 16, the end cap 14 and the insulating layer 20 from corrosion due to corrosive metal or compound (e.g., metal halide) otherwise condensed around the electrode 16, thereby contributing to prolonging a life expectancy of the envelope 6.

Figure 9:
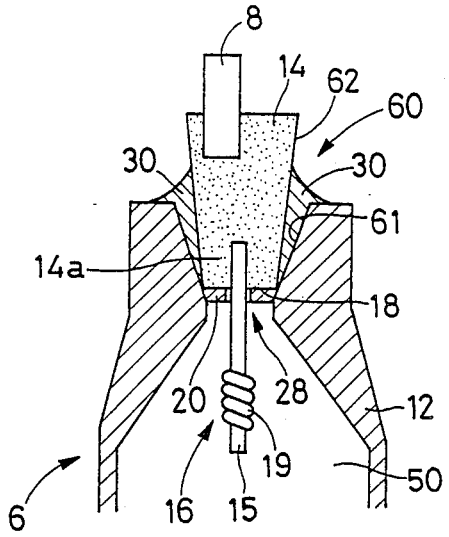
FIG. 9 is a view corresponding to FIG. 2, illustrating another example of the ceramic envelope device of the invention.

Moreover, as shown in FIG. 9, the first and second cylindrical portions 31, 32 of the arc tube 12 of the illustrated embodiment of FIGS. 1 and 2 may be replaced by a combination of a tapered bore 60 formed at an end of the arc tube which is defined by a tapered inner surface 61, and a tapered outer surface 62 of an engaging portion of the corresponding end cap whose taper angle is smaller than that of the tapered inner surface 61 of the arc tube. The tapered inner surface 61 of the arc tube functionally corresponds to the shoulder surface 44 of the arc tube 12 of the illustrated embodiment.

What is claimed is:

1. A ceramic envelope device for a high-pressure metal-vapor discharge lamp, comprising:

a translucent ceramic tube having longitudinally spaced opposite ends;

a pair of electrically conductive end caps which close said opposite ends of said translucent ceramic tube, respectively, each of said end caps having an engaging portion which engages the corresponding one of said opposite ends of the translucent ceramic tube;

a pair of oppositely located discharge electrodes, each of which is supported at a first end thereof by a corresponding one of said end caps such that a second end of said each discharge electrode opposite to said first end thereof protrudes from an inner surface of said corresponding end cap in a longitudinally inward direction in said ceramic tube;

an electrical insulator provided for at least one of said pair of end caps, said electrical insulator covering at least the inner surface of the corresponding one of said at least one end cap; and a sealing member disposed to maintain fluid-tightness between said engaging portion of each of said at least one end cap for which said electrical insulator is provided, and the corresponding end of said ceramic tube;

wherein said electrical insulator includes a peripheral portion which covers a peripheral portion of said inner surface of said each of said at least one end cap, and the end of said translucent ceramic tube sealed by said sealing member includes a contact portion which contacts said peripheral portion of said electrical insulator, thereby entirely isolating said sealing member from an inner space in which said second end of said discharge electrodes protrudes.

2. A ceramic envelope device as claimed in claim 1, further comprising a pair of electrical lead members through which electric power is supplied to said pair of discharge electrodes via said pair of ends caps, respectively, each of said electrical lead members being supported on an outer surface of the corresponding end cap.

3. A ceramic envelope device as claimed in claim 1, wherein said end caps are made of an electrically conductive cermet.

4. A ceramic envelope device for a high-pressure metal-vapor discharge lamp, comprising:

a translucent ceramic tube having longitudinally spaced opposite ends;

a pair of electrically conductive end caps which close said opposite ends of said translucent ceramic tube, respectively, each of said end caps having an engaging portion which engages the corresponding one of said opposite ends of the translucent ceramic tube;

a pair of oppositely located discharge electrodes, each of which is supported at a first end thereof by a corresponding one of said end caps such that a second end of said each discharge electrode opposite to said first end thereof protrudes from an inner surface of said corresponding end cap in a longitudinally inward direction in said ceramic tube;

an electrical insulator provided for at least one of said pair of end caps, said electrical insulator covering at least the inner surface of the corresponding one of said at least one end cap; and a sealing member disposed to maintain fluid-tightness between said engaging portion of each of said at least one end cap for which said electrical insulator is provided, and the corresponding end of said ceramic tube;

wherein sad electrical insulator includes a peripheral portion which covers a peripheral portion of said inner surface of said each of said at least one end cap, and the end of said translucent ceramic tube sealed by said sealing member includes a contact portion consisting essentially of a first inner cylindrical surface having a first inside diameter, and a second inner cylindrical surface which is located axially inwardly of said first inner cylindrical surface, said second inner cylindrical surface having a second inside diameter smaller that said first inside diameter, said engaging portion of said each of said at least one end cap for which said electrical insulator and said sealing member are provided having a diameter which is smaller than said first inside diameter and greater than said second inside diameter, thereby entirely isolating said sealing member from an inner space in which said second end of said discharge electrodes protrudes.

5. A ceramic envelope device as claimed in claim 4, wherein said contact portion of the end of the translucent ceramic tube sealed by said sealing member has a shoulder surface disposed between said first and second inner cylindrical surfaces.

6. A ceramic envelope device as claimed in claim 5, wherein said shoulder surface is perpendicular to said first and second inner cylindrical surfaces.

7. A ceramic envelope device for a high-pressure metal-vapor discharge lamp, comprising:

a translucent ceramic tube having longitudinally spaced opposite ends;

a pair of electrically conductive end caps which close said opposite ends of said translucent ceramic tube, respectively, each of said end caps having an engaging portion which engages the corresponding one of said opposite ends of the translucent ceramic tube;

a pair of opposite located discharge electrodes, each of which is supported at a first end thereof by a corresponding one of said end caps such that a second end of said each discharge electrode opposite to said first end thereof protrudes from an inner surface of said corresponding end cap in a longitudinally inward direction in said ceramic tube;

an electrical insulator provided for at least one of said pair of end caps, said electrical insulator covering at least the inner surface of the corresponding one of said at least one end cap; and a sealing member disposed to maintain fluid-tightness between said engaging portion of each of said at least one end cap for which said electrical insulator is provided, and the corresponding end of said ceramic tube;

wherein said electrical insulator includes a peripheral portion which covers a peripheral portion of said inner surface of said each of said at least one end cap, and the end of said translucent ceramic tube sealed by said sealing member includes a contact portion consisting essentially of a tapered bore defined by a tapered inner surface, while said engaging portion of the corresponding end cap has a tapered outer surface whose taper angle is smaller than that of said tapered inner surface, said contact portion consisting of said tapered inner surface, thereby entirely isolating said sealing member from an inner space in which said second end of said discharge electrodes protrudes.

* * * * *